US007766203B2

(12) United States Patent
Marinaj

(10) Patent No.: US 7,766,203 B2
(45) Date of Patent: Aug. 3, 2010

(54) THIGH HOLSTER STRAP

(76) Inventor: Baine Marinaj, 7655 N. FM 620 # 625, Austin, TX (US) 78726

( * ) Notice: Subject to any disclaimer, the term of this patent is extended or adjusted under 35 U.S.C. 154(b) by 1259 days.

(21) Appl. No.: 11/314,489

(22) Filed: Dec. 21, 2005

(65) Prior Publication Data

US 2007/0138226 A1 Jun. 21, 2007

(51) Int. Cl.
*B26B 29/02* (2006.01)
*F41C 33/02* (2006.01)

(52) U.S. Cl. ..... 224/661; 224/232

(58) Field of Classification Search ..... 224/661, 224/232, 671, 674, 578–580, 150, 637, 625, 224/660, 663, 672, 673
See application file for complete search history.

(56) References Cited

U.S. PATENT DOCUMENTS

| | | | | | |
|---|---|---|---|---|---|
| 4,103,807 | A * | 8/1978 | Lyon et al. | ..... | 224/222 |
| 4,953,767 | A * | 9/1990 | Bennett | ..... | 224/192 |
| 5,445,303 | A * | 8/1995 | Cawile, Jr. | ..... | 224/222 |
| 5,669,170 | A * | 9/1997 | Norris | ..... | 42/85 |
| 5,855,306 | A * | 1/1999 | Masak | ..... | 224/250 |
| 6,149,042 | A * | 11/2000 | Rassias | ..... | 224/661 |
| 6,431,420 | B1 * | 8/2002 | Cragg | ..... | 224/223 |

* cited by examiner

*Primary Examiner*—Nathan J Newhouse
*Assistant Examiner*—Corey N Skurdal

(57) ABSTRACT

An apparatus suitable for securing a tool holster to the thigh of a user which apparatus is particularly adapted for use in connection with diving tools and underwater use. The apparatus utilizes an arrangement of straps and fittings to securely position the diving tool holster on the user's thigh when the user is actively moving underwater.

4 Claims, 3 Drawing Sheets

THIGH HOLSTER STRAP

BACKGROUND OF THE INVENTION a. Field of the Invention

The present invention is related generally to the field of apparatus useful to secure tool holsters to the body of users actively engaged in underwater activities.

Generally, apparatus such as the instant invention suffer from design optimization for lower leg or calf mounting on the user. Additionally, apparatus such as the instant invention fail to provide for the reliable, consistent positional placement of the tool holster on the user's body. Further, apparatus such as the instant invention often lack the flexibility and light-weight characteristics desirable for use by divers. Yet further, apparatus such as the instant invention often fail to be quickly and easily attached and/or removed from the diver's thigh. Finally, apparatus such as the instant invention are sometimes constructed in a complex manner and thereby become expensive to manufacture.

Accordingly, and more particularly, the instant invention is related to apparatus useful to secure tool holsters to the thigh of divers engaged in underwater activities.

Yet more particularly, the instant invention is related to apparatus useful to reliably, consistently position and secure tool holsters to the thigh of divers engaged in underwater activities.

Yet more particularly, the instant invention is related to flexible, light-weight apparatus useful to secure tool holsters to the thigh of divers engaged in underwater activities.

Even yet more particularly, the instant invention is related to apparatus which is quickly and easily attached and/or removed from the diver's thigh and is useful to secure tool holsters to the thigh of divers engaged in underwater activities.

In final point of particularity, the instant invention is related to flexible, light-weight apparatus useful to reliably, consistently position and secure tool holsters to the thigh of divers engaged in underwater activities and which is inexpensive to manufacture and may be quickly and easily attached and/or removed from the diver's thigh.

b. Description of the Prior Art

There are numerous apparatus suitable for securing tool holsters to a diver's thigh in common usage. However, no known apparatus encompasses or embodies all of the features of the instant invention or encompasses the use of such features as hereinafter disclosed.

Generally, apparatus such as the instant invention suffer from design optimization for lower leg or calf mounting on the user. Additionally, apparatus such as the instant invention fail to provide for the reliable, consistent positional placement of the tool holster on the user's body. Further, apparatus such as the instant invention often lack the flexibility and light-weight characteristics desirable for use by divers. Yet further, apparatus such as the instant invention often fail to be quickly and easily attached and/or removed from the diver's thigh. Finally, apparatus such as the instant invention are sometimes constructed in a complex manner and thereby become expensive to manufacture.

Accordingly, and more particularly, the instant invention is related to apparatus useful to secure tool holsters to the thigh of divers engaged in underwater activities.

Yet more particularly, the instant invention is related to apparatus useful to reliably, consistently position and secure tool holsters to the thigh of divers engaged in underwater activities.

Yet more particularly, the instant invention is related to flexible, light-weight apparatus useful to secure tool holsters to the thigh of divers engaged in underwater activities.

Even yet more particularly, the instant invention is related to apparatus which is quickly and easily attached and/or removed from the diver's thigh and is useful to secure tool holsters to the thigh of divers engaged in underwater activities.

In final point of particularity, the instant invention is related to flexible, light-weight apparatus useful to reliably, consistently position and secure tool holsters to the thigh of divers engaged in underwater activities and which is inexpensive to manufacture and may be quickly and easily attached and/or removed from the diver's thigh.

SUMMARY OF THE INVENTION

The instant invention is of an apparatus suitable for securing a tool holster to the thigh of a user, which apparatus is particularly adapted for use in connection with diving tools and underwater use.

The primary problem in the prior art addressed by the instant invention is that no known prior art apparatus provides for the reliable, consistent positioning and securing of tool holsters to the thigh of divers engaged in underwater activities.

Accordingly, it is an object of the instant invention to provide apparatus which provides for the reliable, consistent positioning and securing of tool holsters to the thigh of divers engaged in underwater activities.

It is another object of the instant invention to provide a flexible, light-weight apparatus useful to secure tool holsters to the thigh of divers engaged in underwater activities.

It is yet another object of the instant invention to provide an apparatus which is quickly and easily attached and/or removed from the thigh of a diver engaged in underwater activities.

It is yet a further object of the instant invention to provide an apparatus which is flexible and light-weight and useful to reliably, consistently position and secure tool holsters to the thigh of divers engaged in underwater activities.

It is yet a further and final object of the instant invention to provide an apparatus useful to secure tool holsters to the thigh of divers engaged in underwater activities, which is inexpensive to manufacture.

DESCRIPTION OF NUMERIC REFERENCES

20. Holster
25. User
30. Tool
40. Waist Belt Strap
50. Waist Belt Male Connection Fitting
51. First Waist Belt Male Connection Fitting Eye
52. Second Waist Belt Male Connection Fitting Eye
60. Waist Belt Female Connection Fitting
61. First Waist Belt Female Connection Fitting Eye
62. Second Waist Belt Female Connection Fitting Eye
70. Waist Belt Dual Adjustable Buckle
71. First Waist Belt End
72. Second Waist Belt End
80. Slideable Tee Fitting
81. First Slideable Tee Fitting Eye
82. Second Slideable Tee Fitting Eye
83. Third Slideable Tee Fitting Eye
90. First Tri-lock Fitting
91. First First Tri-lock Fitting Eye

92. Second First Tri-lock Fitting Eye
100. Single Lock Double Bar Fitting, functioning as an Adjustable Tension Lock
101. First Single Lock Double Bar Fitting Eye
102. Second Single Lock Double Bar Fitting Eye
103. Third Single Lock Double Bar Fitting Eye
104. Recessed Region of Single Lock Double Bar Fitting
110. Second Tri-lock Fitting
120. Third Tri-lock Fitting
130. Fourth Tri-lock Fitting
140. Upper Thigh Strap
141. First Upper Thigh Strap End
142. Second Upper Thigh Strap End
150. Lower Thigh Strap
151. Second Lower Thigh Strap End

BRIEF DESCRIPTION OF THE DRAWINGS

While the novel features of the instant invention are set forth with particularity in the appended claims, a full and complete understanding of the invention can be had by referring to the detailed description of the preferred embodiment which is set forth subsequently, and which is as illustrated in the accompanying drawings, in which:

DESCRIPTION OF THE PREFERRED EMBODIMENT(S)

The instant invention is of an apparatus suitable for securing a tool holster to the thigh of a user, which apparatus is particularly adapted for use in connection with diving tools and underwater use. The most complete depiction of the instant invention is available as FIG. 1.

Figure 1:
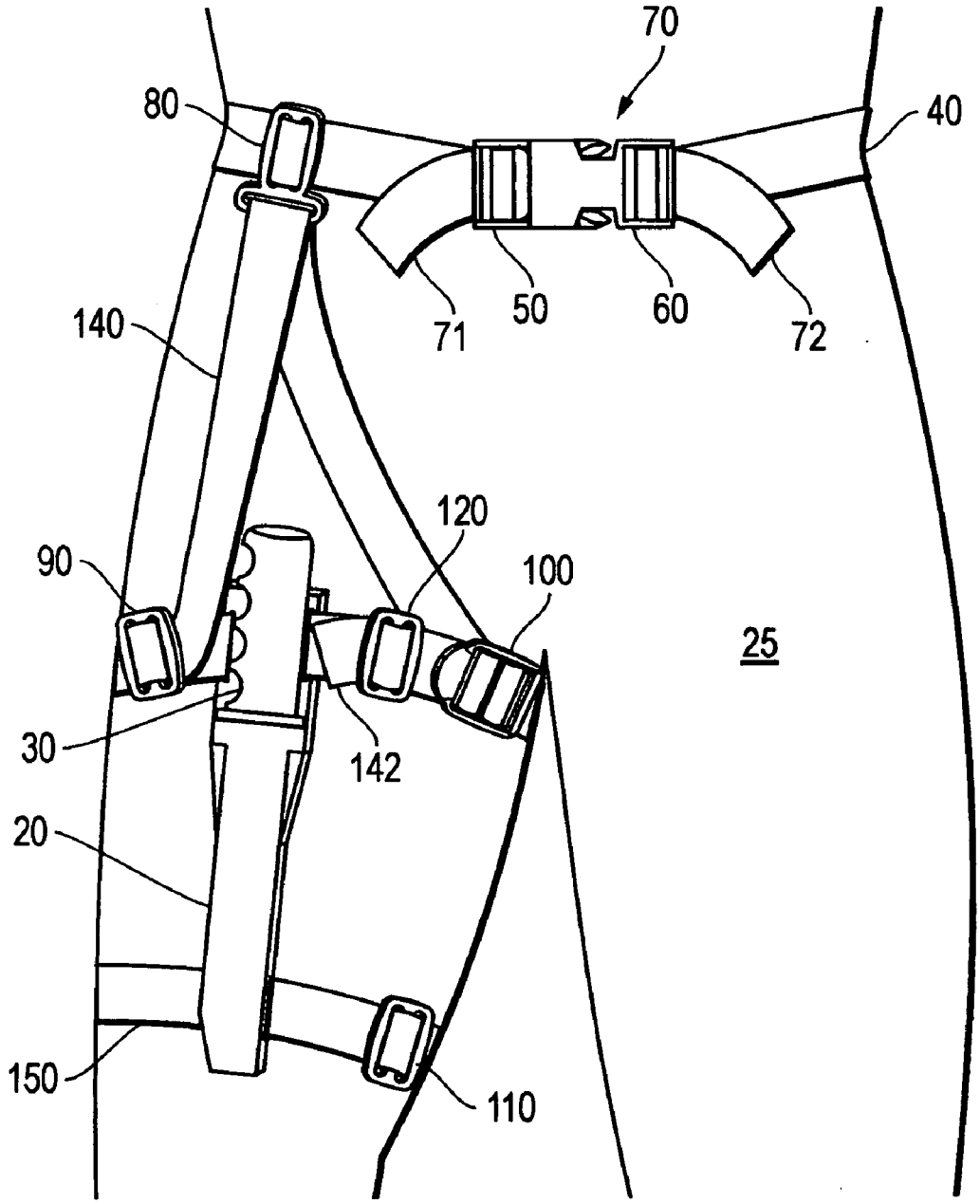
FIG. 1 is a perspective view of the apparatus of the instant invention on a user with the holster attached.

As shown in FIG. 1, the instant invention is of an apparatus suitable for securing a tool holster 20 to the thigh of a user 25 comprising a waist belt strap 40, a waist belt dual adjustable buckle 70, a slideable tee fitting 80, an upper thigh strap 140, a first tri-lock fitting 90, a second tri-lock fitting 110, a single lock double bar fitting 100 which functions as an adjustable tension lock, a lower thigh strap 150, and a third tri-lock fitting 120. Additionally, and optionally, the apparatus of the instant invention may comprise a third tri-lock fitting 120 which serves as a lateral slide stop to the position of the holster 20 along upper thigh strap 140. The holster 20 may be fastened or attached onto the upper thigh strap 140 and the lower thigh strap 150 in a myriad of ways, provided only that the holster 20 is securely but slideably affixed to both the upper and lower thigh straps 140 and 150, respectively. The holster 20 is such as will reliably and securely receive any of many common tools 30 useful to a user 25. The most common tool 30 is a diver's knife. Thus, the peculiar usefulness of the instant invention for divers and depiction of the preferred embodiment as an apparatus for the securing of a diver's knife to a diver's thigh. Most diver's knives are secured by straps or other apparatus to the diver's calf and are not, therefore, nearly as readily available and useful to the diver, user 25, as the tool 30 in the holster 20 of the instant invention.

Figure 2:
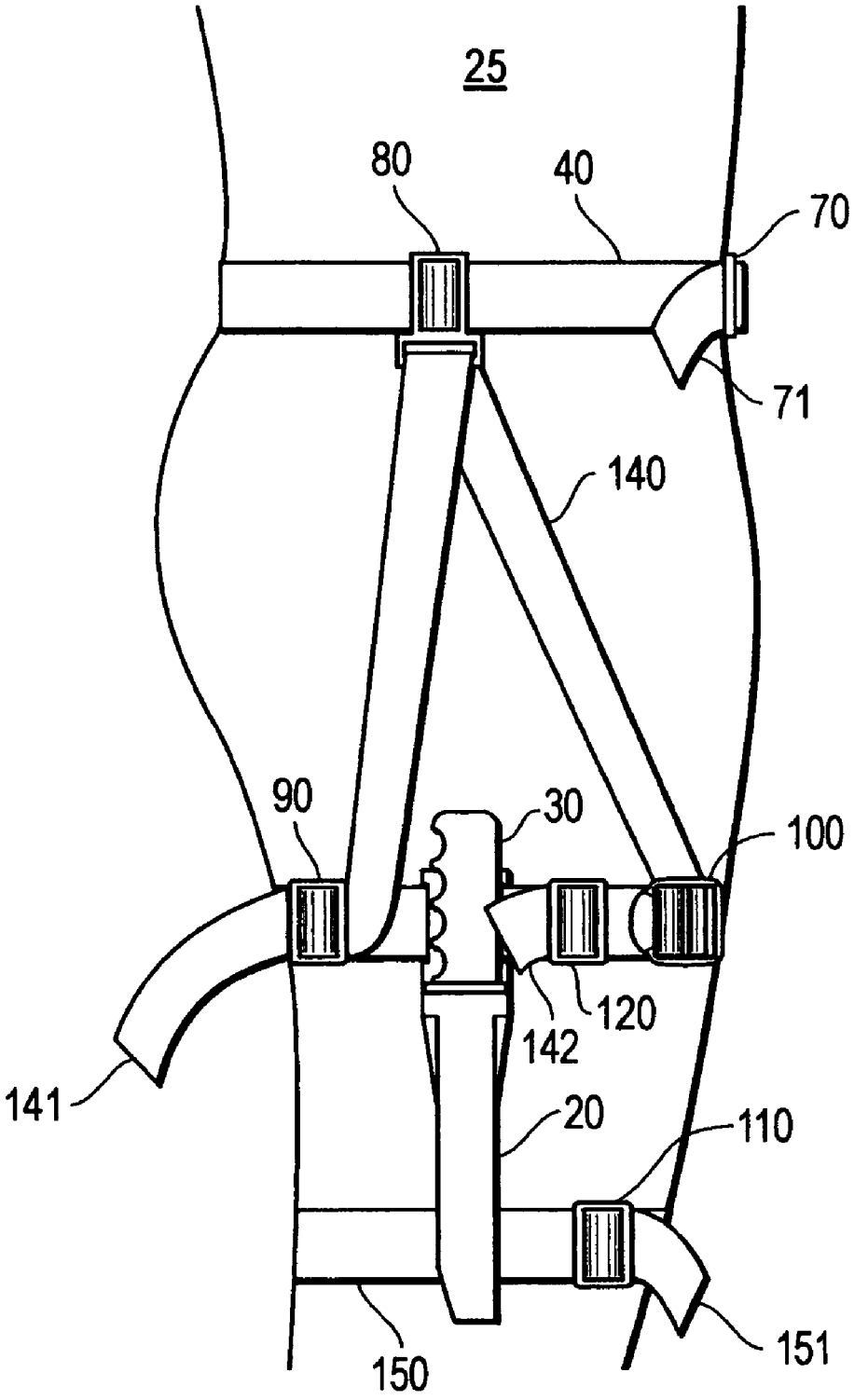
FIG. 2 is a lateral plane view of the apparatus of the instant invention on a user with the holster attached.
Figure 3:
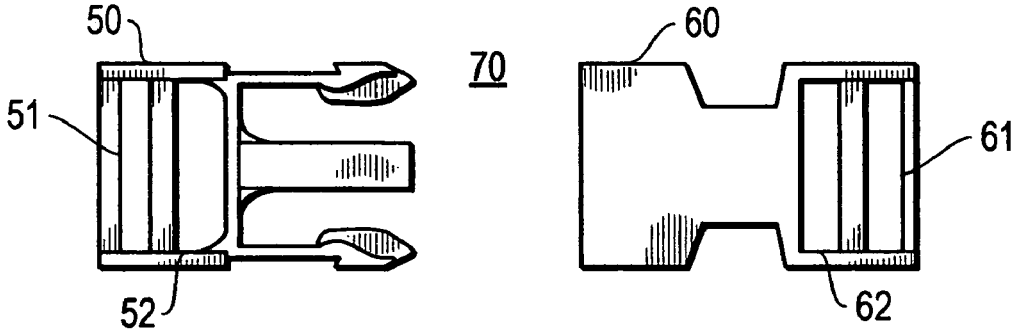
FIG. 3 is an exploded horizontal plane view of the waist belt dual adjustable buckle.

In more detail, considering both FIG. 1 and FIG. 2, the instant invention is seen to comprise a waist belt strap 40 which provides both a first waist belt end 71 and a second waist belt end 72. The instant invention is further seen to comprise a waist belt dual adjustable buckle 70 (depicted in detail in FIG. 3) which provides a male connection fitting 50 and a female connection fitting 60. The male connection fitting 50, in turn, provides both a first male connection fitting eye 51 and a second male connection fitting eye 52. The female connection fitting 60 provides both a first female connection fitting eye 61 and a second female connection fitting eye 62. Once assembled by the user 25 the waist belt dual adjustable buckle 70 is adjusted by threading lengths of the first waist belt end 71 through the first male connection fitting eye 51 and the second male connection fitting eye 52 and lengths of the second waist belt end 72 through the first female connection fitting eye 61 and the second female connection fitting eye 61, and the waist belt dual adjustable buckle 70 maintains the tension in the waist belt strap 40 by connecting the male connection fitting 50 to the female connection fitting 60.

Figure 6:
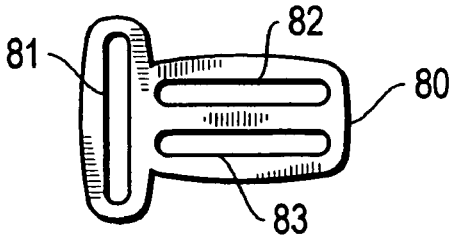
FIG. 6 is a horizontal plane view of the slideable tee fitting.

The instant invention is further seen to comprise a slideable tee fitting 80 (depicted in detail in FIG. 6) which provides a slideable tee horizontal fitting eye 81, a first slideable tee vertical fitting eye 82, and a second slideable tee vertical fitting eye 83. Note in this regard that FIG. 6 is rotated 90 degrees from the depiction of the slideable tee fitting 80 depicted in FIGS. 1 and 2. Slideable tee fitting 80, when placed under tension after installation on the waist belt strap 40 by the user 25, acts as an anchor holding the upper thigh strap 140 in position on the waist belt strap 40.

Figure 5:
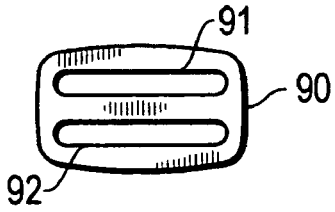
FIG. 5 is a horizontal plane view of the first tri-lock fitting.

The instant invention is further seen (FIGS. 1 and 2) to comprise three tri-lock fittings 90 (depicted in detail in FIG. 5), 110 and 120. Each tri-lock fitting, as seen by reference to the first tri-lock fitting 90 as depicted in FIG. 5, provides a first tri-lock fitting eye 91 and a second tri-lock fitting eye 92. Thus the second tri-lock fitting 110 will likewise be seen to provide a third tri-lock fitting eye (not referenced, depicted in FIG. 1) and a fourth tri-lock fitting eye (not referenced, depicted in FIG. 1) and the third tri-lock fitting 120 will likewise be seen to provide a fifth tri-lock fitting eye (not referenced, depicted in FIG. 1) and a sixth tri-lock fitting eye (not referenced, depicted in FIG. 1).

Figure 4:
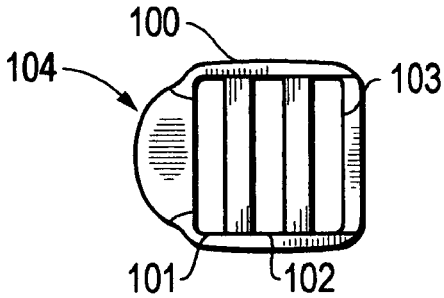
FIG. 4 is a horizontal plane view of the adjustable tension lock, a single lock double bar fitting.

The instant invention is further seen to comprise a single lock double bar fitting 100 (depicted in detail in FIG. 4) which provides a first tension lock fitting eye 101, a second tension lock fitting eye 102, and a third tension lock fitting eye 103. The naming convention for the first, second, and third fitting eyes 101, 102, and 103, respectively, arises from the functional usage of the single lock double bar fitting 100 in the instant invention as a tension lock fitting.

The instant invention is further seen (again, by reference to FIGS. 1 and 2) to comprise an upper thigh strap 40 which provides both a first upper thigh strap end 141 and a second upper thigh strap end 142; and a lower thigh strap 150 which provides a first lower thigh strap end (not depicted) and a second lower thigh strap end 151.

Assembly of the instant invention is accomplished by threading the first waist belt end 71 through the first slideable tee vertical fitting eye 82 and then through the second slideable tee vertical fitting eye 83. The first waist belt end 71 is then threaded through the first male connection fitting eye 51 and through the second male connection fitting eye 52. The second waist belt end 72 is then threaded through the first female connection fitting eye 61 and then through the second female connection fitting eye 62. The male connection fitting 50 is connected to the female connection fitting 60, around the waist of the user 25 and all waist belt strap 40 threadings are adjusted to comfortably, but snugly fit the user 25.

Continuing the assembly of the instant invention, the second upper thigh strap end 142 is threaded through the slideable tee horizontal fitting eye 81 and then the second upper thigh strap end 142 is threaded through the second tension lock fitting eye 102 (also referred to as the second single lock double bar fitting eye 102). Next, the second upper thigh strap end 142 is threaded through the third tension lock fitting eye 103 (also referred to as the third single lock double bar fitting eye 103). This is followed by the second upper thigh strap end 142 being threaded through the first tri-lock fitting eye 91 and the second upper thigh strap end 142 being threaded through the second tri-lock fitting eye 92.

Continuing the assembly of the instant invention, the first upper thigh strap end 141 is next threaded through the second tri-lock fitting eye 92 and through the first tri-lock fitting eye 91.

Continuing the assembly of the instant invention, the second upper thigh strap end 142 is then threaded through said third tri-lock fitting eye (not referenced, depicted as the first eye of the third tri-lock fitting 120) and through the fourth tri-lock fitting eye (not referenced, depicted as the second eye of the third tri-lock fitting 120). Next, the second upper thigh strap end 142 is threaded through the fifth tri-lock fitting eye (not referenced, depicted as the first eye of the second tri-lock fitting 110) and threaded through the sixth tri-lock fitting eye (not referenced, depicted as the second eye of the second tri-lock fitting 110).

Optionally, and as depicted in FIG. 1, the second upper thigh strap end 142 is next threaded through the second eye of the third tri-lock fitting 120 and then through the first eye of the third tri-lock fitting 120. This serves as an additional friction lock upon the movement of the third tri-lock fitting 120 and thus upon the slideability of the holster 20.

If the holster 20 is connected to the upper thigh strap 140 by fitting eyes (not depicted) in the material of the holster 20, then the upper thigh strap 140 will need to also be threaded through the holster 20 fitting eyes before adjustment of the upper thigh strap 140 threadings by the user 25. Note that in the assembled instant invention the third tri-lock fitting 120 provides the fifth tri-lock fitting eye (not referenced, depicted as the first eye of the third tri-lock fitting 120) and the sixth tri-lock fitting eye (not referenced, depicted as the second eye of the third tri-lock fitting 120) through which fitting eyes the second upper thigh strap end 142 is threaded so that the third tri-lock fitting 120 serves as a "stop" to the slideability of the holster 20 along the upper thigh strap 140.

Continuing the assembly of the instant invention, the first lower thigh strap end (not depicted) is connected to the second tri-lock fitting 110 and the second lower thigh strap end 151 is then threaded through the fourth tri-lock fitting eye (not referenced, depicted as the first eye of the second tri-lock fitting 110), and then threaded through the fourth tri-lock fitting eye, (not referenced, depicted as the second eye of the second tri-lock fitting 110). If the holster 20 is connected to the lower thigh strap 150 by fitting eyes (not depicted) in the material of the holster 20, then the lower thigh strap 150 will need to also be threaded through the holster 20 fitting eyes before adjustment of the lower thigh strap 150 threadings by the user 25.

Economic Benefit Statement

The instant invention, by virtue of its relative few components, may be distributed and sold in an unassembled kit, sans holster 20, for assembly and attachment of the user's 25 choice of holsters 20 suitable for the user's 25 selected tool 30. Thus the versatility of the instant invention becomes apparent, as the holster 20 may be attached in innumerable ways and the selected tool 30 may be any of a myriad of useful items. Assembly of the instant invention is labor intensive and is labor best supplied by the user 25 as necessary adjustment and fitting of the various straps 40, 140 and 150, and fittings 70, 80, 90, 100, 110, and 120, are most comfortably and uniquely suited to the individual user 25. Thus, the low cost of the marketed version of the instant invention is virtually compelled by its user 25 customizable assembly.

While the preferred embodiments of the instant invention have been described in substantial detail and fully and completely hereinabove, it will be apparent to one skilled in the art that numerous variations of the instant invention may be made without departing from the spirit and scope of the instant invention, and accordingly the instant invention is to be limited only by the following claims.

I claim:

1. An apparatus suitable for securing a tool holster to the thigh of a user, said apparatus comprising:

a waist belt strap having a first and second waist belt ends;

a dual adjustable buckle having a female and male connection fittings, said male connection fitting includes first and second male connection fitting eyes, said female connection fitting includes first and second female connection fitting eyes; wherein said first and second female connection fitting eyes are connected to said first waist belt end, and said first and second male connection fitting eyes are connected to said second waist belt end;

a slideable tee fitting having a slideable tee horizontal fitting eye, a first slideable tee vertical fitting eye, and a second slideable tee vertical fitting eye, wherein said waist belt strap is threaded through said first and second slideable tee vertical fitting eyes;

an upper thigh strap having a first and second upper thigh strap end, said second upper thigh strap end is threaded through said slideable tee horizontal fitting eye;

a first tri-lock fitting having a first and second tri-lock fitting eyes, wherein said first and second upper thigh strap ends are threaded through said first and second tri-lock fitting eyes;

a second tri-lock fitting having a third and fourth tri-lock fitting eyes, wherein said second upper thigh strap end is threaded through said third and fourth tri-lock fitting eyes; and a single lock double bar fitting having a first, second and third tension lock fitting eyes, wherein said first upper thigh strap is threaded through said first, second and third tension lock fitting eyes, and said second upper thigh strap end is threaded through said second and third tension lock fitting eyes; and a holster is connected to said upper thigh strap.

2. The apparatus of claim 1, wherein said apparatus further includes a lower thigh strap.

3. The apparatus of claim 2, wherein said holster is connected to and said lower thigh strap.

4. The apparatus of claim 2, wherein said apparatus further includes a third tri-lock fitting having a fifth and sixth tri-lock fitting eyes, wherein said lower thigh strap is threaded through said fifth and sixth tri-lock fitting eyes.

* * * * *